US010166157B2

(12) United States Patent
Sato

(10) Patent No.: US 10,166,157 B2
(45) Date of Patent: Jan. 1, 2019

(54) WHEELCHAIR FRAME STRUCTURE AND METHOD FOR ADJUSTING WHEELCHAIR

(71) Applicant: MIKI HOLDINGS Co.,Ltd, Nagoya-shi (JP)

(72) Inventor: Hisayoshi Sato, Nagoya (JP)

(73) Assignee: MIKI HOLDINGS CO., LTD., Nagoya-Shi (JP)

( * ) Notice: Subject to any disclaimer, the term of this patent is extended or adjusted under 35 U.S.C. 154(b) by 0 days.

(21) Appl. No.: 15/826,677

(22) Filed: Nov. 30, 2017

(65) Prior Publication Data

US 2018/0296408 A1 Oct. 18, 2018

(30) Foreign Application Priority Data

Apr. 17, 2017 (JP) ..... 2017-081689

(51) Int. Cl.
*A61G 5/10* (2006.01)

(52) U.S. Cl.
CPC ..... *A61G 5/1059* (2013.01)

(58) Field of Classification Search
CPC ..... A61G 5/10; A61G 5/1056; A61G 5/1059
See application file for complete search history.

(56) References Cited

U.S. PATENT DOCUMENTS 4,477,117 A * 10/1984 Higgs ..... A61G 5/08 280/250.1
4,489,981 A * 12/1984 Goletski ..... A61G 5/12 297/411.36
5,320,373 A * 6/1994 Robertson ..... A61G 5/00 280/250.1
6,431,650 B1 * 8/2002 Visone ..... A61G 5/1059 280/250.1
7,246,821 B2 * 7/2007 Sato ..... A61G 5/08 280/793
7,281,724 B1 * 10/2007 Larson ..... A61G 5/00 280/250.1
8,985,618 B2 * 3/2015 Perk ..... A61G 5/02 280/250.1
2007/0119662 A1 * 5/2007 Muller ..... A61G 5/02 188/2 F
2016/0220432 A1 * 8/2016 Ooyama ..... A61G 5/1021

FOREIGN PATENT DOCUMENTS

JP 2016-67616 5/2016

* cited by examiner

*Primary Examiner* — Brian L Swenson
(74) *Attorney, Agent, or Firm* — Mori & Ward, LLP

(57) ABSTRACT

A front wheel and a rear wheel are to be provided at a grounding frame. A body frame is mounted on the grounding frame and includes a mount at which a seat is to be provided. A relative position between the grounding frame and the body frame in a height direction of a wheelchair is changed via a height adjustment mechanism. The height adjustment mechanism includes an adjustment pole, a pole reception, and a holding portion. The adjustment pole extends along the height direction and is mounted on one of the body frame and the grounding frame. The pole reception is mounted on another of the body frame and the grounding frame and is engaged with the adjustment pole slidably in the height direction. The holding portion is to hold not to relatively move the adjustment pole with respect to the pole reception.

5 Claims, 7 Drawing Sheets

WHEELCHAIR FRAME STRUCTURE AND METHOD FOR ADJUSTING WHEELCHAIR

CROSS-REFERENCE TO RELATED APPLICATIONS

The present application claims priority under 35 U.S.C. § 119 to Japanese Patent Application No. 2017-081689, filed Apr. 17, 2017. The contents of this application are incorporated herein by reference in its entirety.

BACKGROUND OF THE INVENTION

Field of the Invention

The present invention relates to a wheelchair frame structure and a method for adjusting a wheelchair.

DISCUSSION OF THE BACKGROUND

As disclosed in Japanese Patent Application Publication No. 2016-67616, for example, there is well known a conventional wheelchair that includes a body frame with a pair of side frames having a seat portion and support frames. Casters as front wheels, main wheels as rear wheels, and parking brakes capable of stopping rotation of the main wheels by a pressure applied on peripheral surfaces of the main wheels are mounted on the body frame.

SUMMARY OF THE INVENTION

According to one aspect of the present invention, a wheelchair frame structure includes a grounding frame, a body frame, a height adjustment mechanism. A front wheel and a rear wheel are to be provided at the grounding frame. The body frame is mounted on the grounding frame and includes a mount at which a seat is to be provided. A relative position between the grounding frame and the body frame in a height direction of a wheelchair is changed via the height adjustment mechanism. The height adjustment mechanism includes an adjustment pole, a pole reception, and a holding portion. The adjustment pole extends along the height direction and is mounted on one of the body frame and the grounding frame. The pole reception is mounted on another of the body frame and the grounding frame and is engaged with the adjustment pole slidably in the height direction. The holding portion is to hold not to relatively move the adjustment pole with respect to the pole reception.

According to another aspect of the present invention, a method for adjusting a wheelchair is disclosed. The method includes releasing holding of an adjustment pole and a pole reception slidably engaged with each other in a height direction of the wheelchair, one of the adjustment pole and the pole reception being mounted on a body frame, another of the adjustment pole and the pole reception being mounted on a grounding frame at which a front wheel and a rear wheel are to be provided. The method includes relatively sliding the adjustment pole and the pole reception in the height direction such that a mount of the body frame at which a seat is to be provided moves relative to the grounding frame in the height direction. The method includes holding not to relatively move the adjustment pole with respect to the pole reception.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
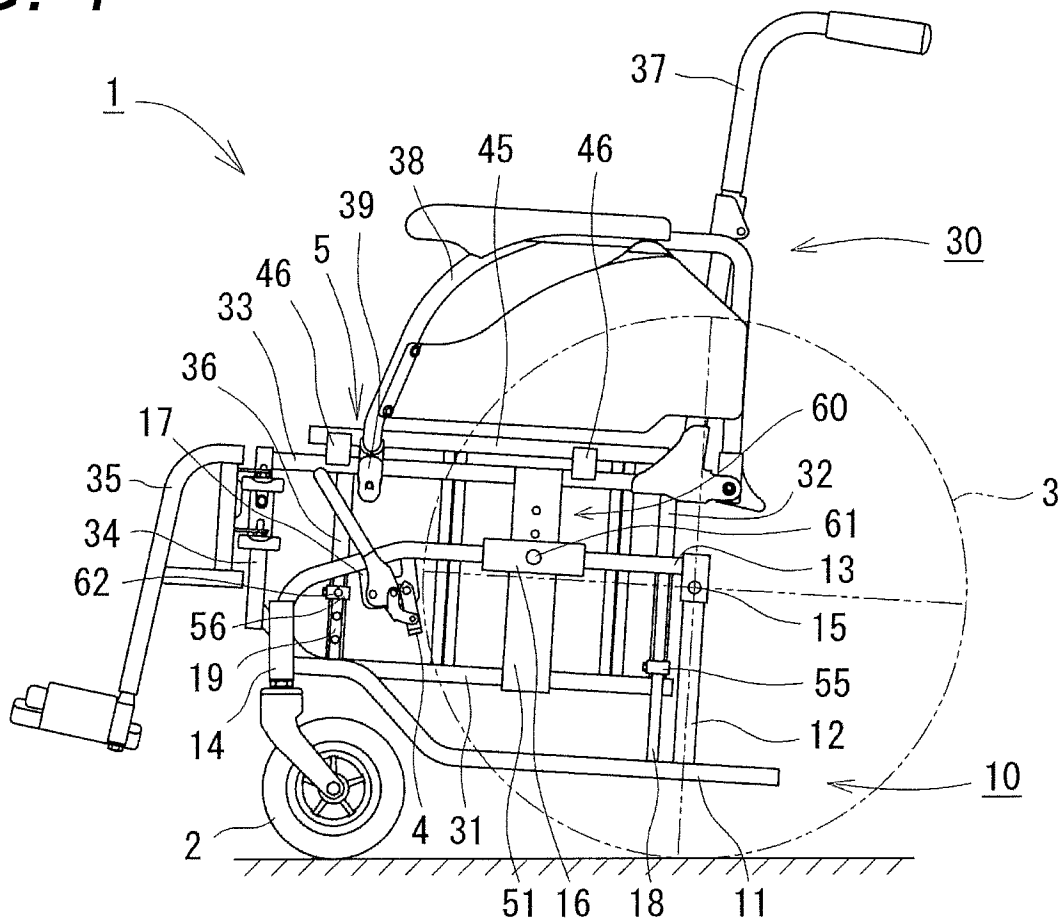
FIG. 1 is a right elevational view, illustrating a wheelchair according to an embodiment.

The embodiment(s) will now be described with reference to the accompanying drawings, wherein like reference numerals designate corresponding or identical elements throughout the various drawings.

Hereinafter, a wheelchair according to an embodiment is described in detail. The present invention is not limited to the embodiments described below, and its design may be appropriately modified.

As illustrated in FIG. 1, a wheelchair 1 includes grounding frame members 10 on which casters 2 as front wheels and main wheels 3 as rear wheels are mounted.

The wheelchair 1 further includes a body frame member 30 having a seat portion 5.

Here, the grounding frame members 10 and the body frame member 30 are separate. Each of the grounding frame members 10 and the body frame member 30 are connected to each other through a connecting pin 61 (a holding portion) as a fixing means. Note that the grounding frame members 10 as a pair of right and left members are disposed on the body frame member 30. The right grounding frame member 10 has a symmetrical shape to the left grounding frame member 10, so that further detailed description will not be repeated.

Next, the grounding frame member 10 is described.

Figure 2:
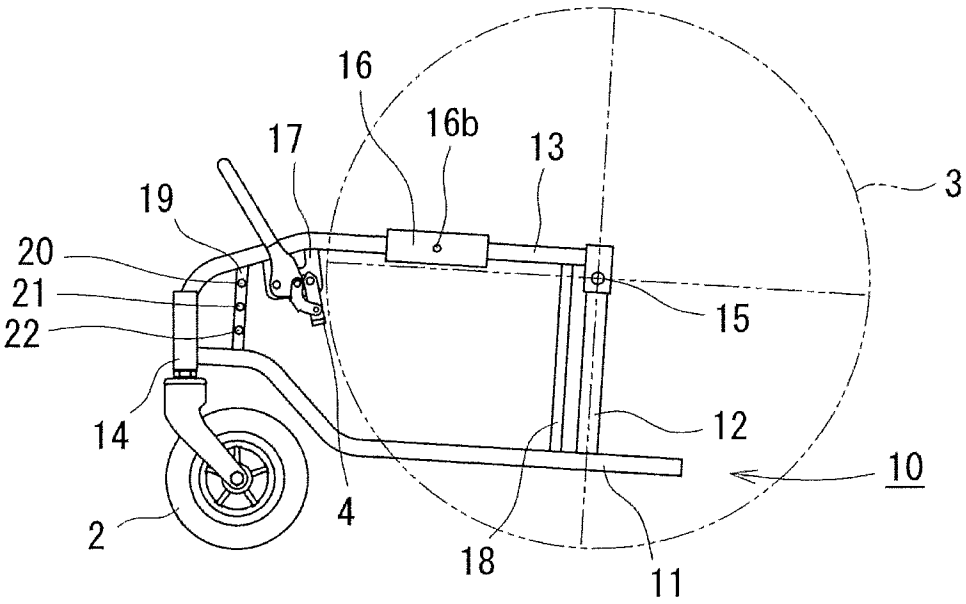
FIG. 2 is a right elevational view, illustrating a grounding frame member according to the embodiment.

As illustrated in FIG. 2, the grounding frame member 10 includes a grounding lower frame 11 disposed in the anterior-posterior direction (a front-rear direction of the wheelchair 1), a grounding rear frame 12 extending upward from a rear end portion of the grounding lower frame 11, and a grounding upper frame 13 extending to the front from an upper end portion of the grounding rear frame 12.

A front end portion of the grounding lower frame 11 and a front end portion of the grounding upper frame 13 are joined together with a caster mounting pipe 14 on which the caster 2 is mounted. Furthermore, a shaft hole 15 that fixes a shaft of the main wheel 3 is disposed in the upper end portion of the grounding rear frame 12.

Figure 4:
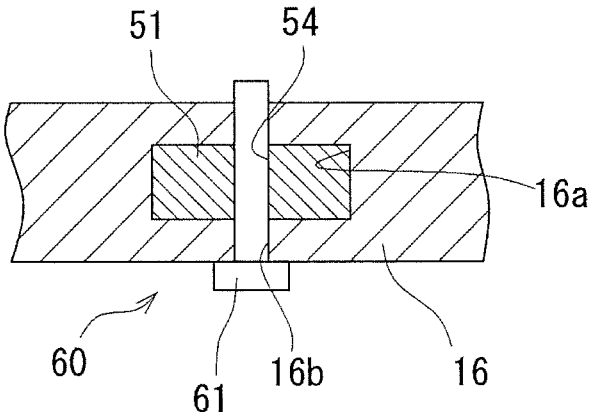
FIG. 4 is a partially enlarged transversely sectional view, illustrating a pole reception portion according to the embodiment.

As shown in FIG. 4, at a generally middle portion of grounding upper frame 13 there is disposed a pole reception portion 16. The pole reception portion 16 has a through hole 16*a* in which an adjustment pole portion 51 of the body frame member 30 described later fits in a vertical direction (a height direction of the wheelchair 1). And the pole reception portion 16 having a connecting pin insertion hole 16*b* that penetrates horizontally through the through hole 16*a*. A brake mounting plate 17 having a plate shape hangs down from a front portion of the grounding upper frame 13. A parking brake 4 is mounted on the brake mounting plate 17.

A rear rail portion 18 extending vertically from the grounding lower frame 11 to the grounding upper frame 13 is disposed in front of the grounding rear frame 12 in a rear end portion of the grounding frame member 10. A front rail portion 19 extending vertically from the grounding lower frame 11 to the grounding upper frame 13 is disposed in the rear of the caster mounting pipe 14 in a front end portion of the grounding frame member 10. First to third rail through holes 20, 21, 22 in the order from top that penetrate horizontally are provided in the front rail portion 19 at a predetermined interval.

Next, the body frame member 30 is described.

Figure 3:
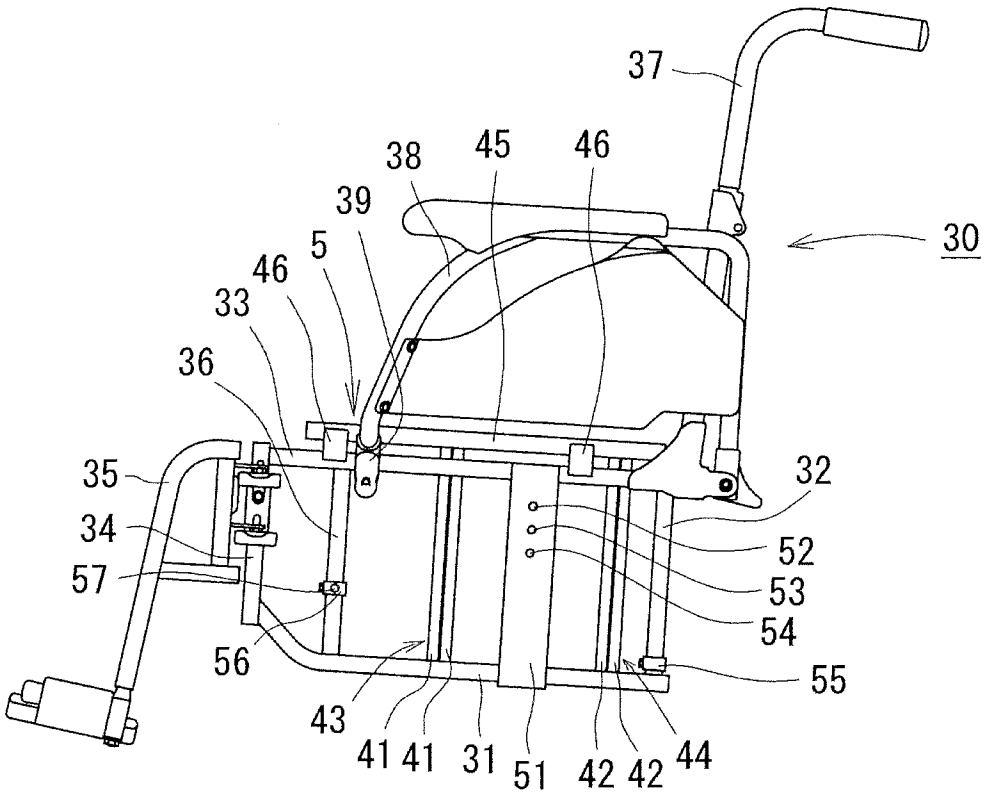
FIG. 3 is a right elevational view, illustrating a body frame member according to the embodiment.

As illustrated in FIG. 3, the body frame member 30 includes a pair of body lower frames 31 disposed in the anterior-posterior direction, a body rear frame 32 extending upward from a rear end portion of the body lower frame 31, and a body upper frame 33 extending to the front from an upper end portion of the body rear frame 32.

A front end portion of the body lower frame 31 and a front end portion of the body upper frame 33 are joined together with a foot rest mounting frame 34 on which a foot rest frame 35 is mounted. Furthermore, an auxiliary frame 36 extending vertically from the body lower frame 31 to the body upper frame 33 is disposed in the rear of the foot rest mounting frame 34 of the body frame member 30.

A back frame 37 extending upward is attached to a rear end portion of the body upper frame 33. An arm rest frame 38 is also pivotally supported at the rear end portion of the body upper frame 33 so as to be flipped up in back. A front end portion of the arm rest frame 38 is removably attached to an arm rest frame fixing portion 39 disposed on the body upper frame 33. Each portion of the body frame member 30 is provided in a pair. This pair is symmetrical, so that the same reference is given to each and description is simplified.

Front rotational rods 41 and rear rotational rods 42 are mounted on each of the pair of body lower frames 31. Each of the pair of body lower frames 31 are coupled to each other by front rotational rods 41 and rear rotational rods 42. The pair of front rotational rods 41, 41 that are connected for rotation each other about the midpoint thereof to form a front X frame 43. The pair of rear rotational rods 42, 42 having the similar configuration forms a rear X frame 44.

A seat pipe 45 (seat frame portion and a mount for a seat) disposed along the anterior-posterior direction is mounted on upper end portions of the front X frame 43 and the rear X frame 44. The seat pipe 45 is supported from below by seat pipe receptions 46 provided on the body upper frame 33 and is fixed thereto when the wheelchair 1 is used. A folding structure of the X frames 43, 44 described above is a technique, which has been well known, so that detailed description will not be repeated.

A seat, which is not shown, is placed between the pair of seat pipes 45, and the seat pipes 45 and the seat form the seat portion 5.

The adjustment pole portion 51 having a flat plate shape is mounted along the vertical direction between the front X frame 43 and the rear X frame 44 of the body lower frame 31 so as to connect the body lower frame 31 and the body upper frame 33. First to third pole portions through holes 52, 53, 54 in the order from top that penetrate from left to right are provided in the adjustment pole portion 51 at a predetermined interval.

A rear guide portion 55 through which the rear rail portion 18 of the grounding frame member 10 freely slides in the vertical direction is fixed to a lower end portion of the body rear frame 32. A front guide portion 56 through which the front rail portion 19 of the grounding frame member 10 freely slides in the vertical direction is fixed to a position a little lower than the center of the auxiliary frame 36. Furthermore, the front guide portion 56 has a guide hole 57 that opens outward in the right and left direction.

Next, an assembling aspect of the grounding frame member 10 and the body frame member 30 is described.

First, to connect the grounding frame member 10 to the body frame member 30, the adjustment pole portion 51 of the body frame member 30 is inserted in the through hole 16*a* of the pole reception portion 16 of the grounding frame member 10 (see FIG. 4). The rear rail portion 18 of the grounding frame member 10 is inserted in and engaged with the rear guide portion 55 of the body frame member 30. Then, the front rail portion 19 of the grounding frame member 10 is inserted in and engaged with the front guide portion 56 of the body frame member 30.

As shown in FIG. 4, the connecting pin insertion hole 16*b* of the pole reception portion 16 is opposed to any of the first to third pole portion through holes 52, 53, 54 of the adjustment pole portion 51, and the connecting pin 61 is inserted therein. This leads to a state where the grounding frame member 10 and the body frame member 30 are connected together. For example, the third pole portion through hole 54 disposed at the lowest position is selected in FIGS. 1 and 4.

At this time, the guide hole 57 of the front guide portion 56 of the body frame member 30 faces the first rail through hole 20 of the front rail portion 19 of the grounding frame member 10, which is positioned highest. By inserting an auxiliary pin 62 in the guide hole 57, the grounding frame member 10 and the body frame member 30 are firmly fixed together.

The adjustment pole portion 51 of the body frame member 30, the pole reception portion 16 of the grounding frame member 10, and the connecting pin 61 form a height adjustment mechanism 60 are configured.

Figure 5:
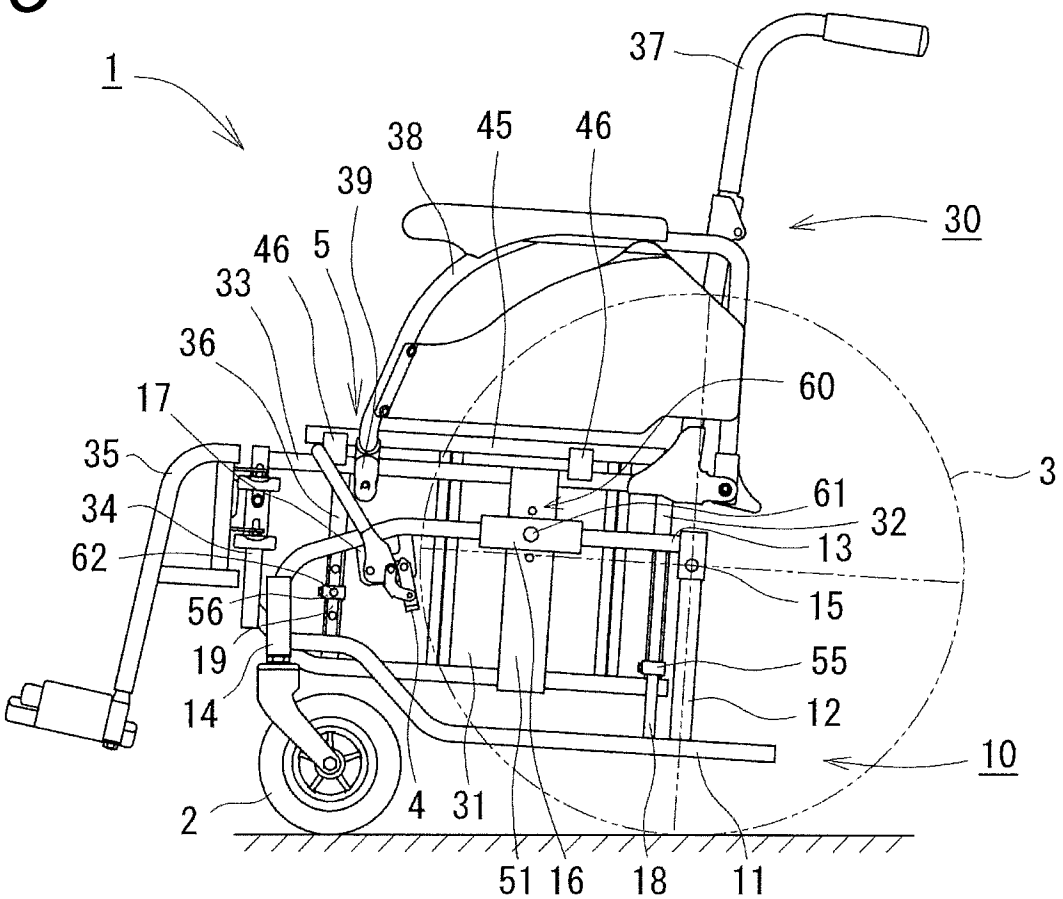
FIG. 5 is a right elevational view, illustrating the wheelchair in which a height of a seat portion is lowered by one step.

To adjust a height of the seat portion 5 in the wheelchair 1 described above, the connecting pin 61 and the auxiliary pin 62 are removed. As shown in FIG. 5, the second pole portion through hole 53 of the adjustment pole portion 51 is opposed to the connecting pin insertion hole 16*b* of the pole reception portion 16, and the connecting pin 61 is inserted therein. In the state where the second rail through hole 21 of the front rail portion 19, which is positioned center faces the guide hole 57 of the front guide portion 56, the auxiliary pin 62 is inserted in the guide hole 57. In this way, the wheelchair 1 with the seat portion 5 lowered by one step than the wheelchair 1 illustrated in FIG. 1 can be provided.

Figure 6:
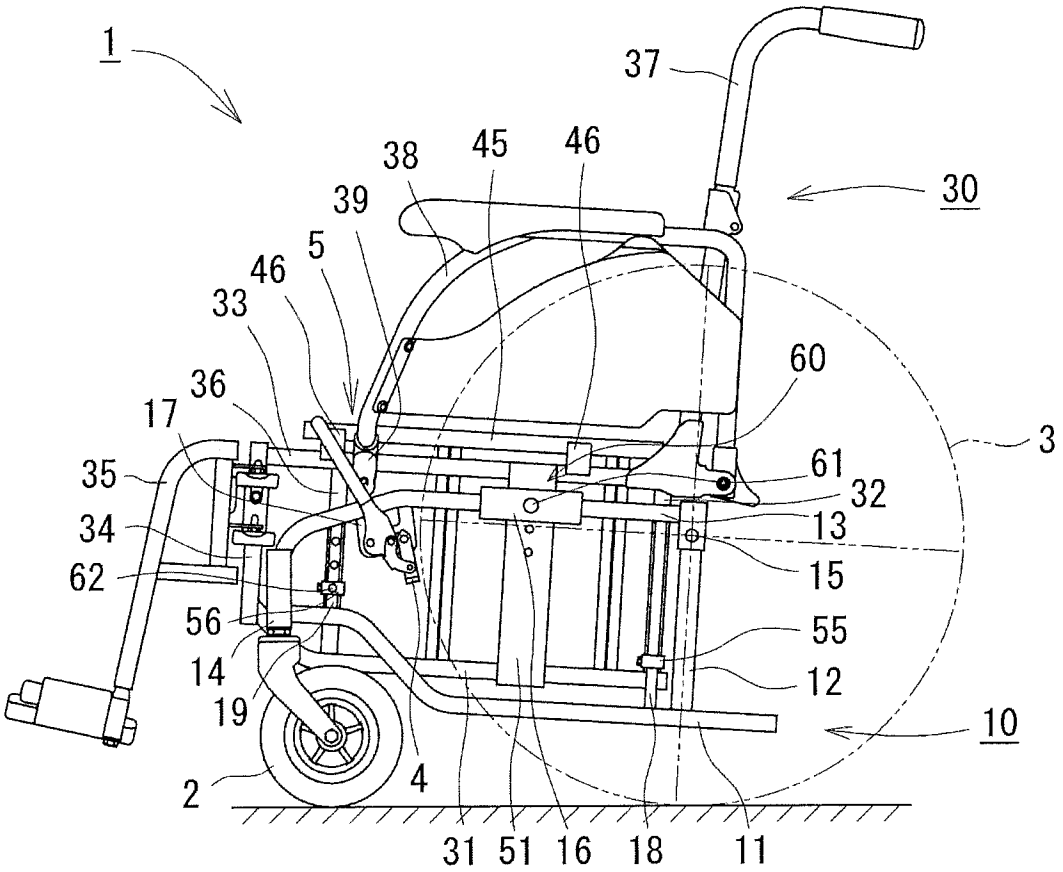
FIG. 6 is a right elevational view, illustrating the wheelchair in which the seat portion is at the lowest height.

Similarly, as illustrated in FIG. 6, the first pole portion through hole 52 of the adjustment pole portion 51 is opposed to the connecting pin insertion hole 16*b* of the pole reception portion 16, and the connecting pin 61 is inserted therein. In the state where the third rail through hole 22 of the front rail portion 19 faces the guide hole 57 of the front guide portion 56, the auxiliary pin 62 is inserted in the guide hole 57. In this way, the seat portion 5 can be set at the lowest in the wheelchair 1.

Even when the height of the seat portion 5 is changed as described above, the casters 2, the main wheels 3, and the parking brakes 4 are still fixed to the grounding frame member 10 and their relative positions to one another are not changed. Thus, a position of each of the portions does not need to be adjusted after the height of the seat portion 5 is changed.

Note that dimensions and shapes of each of the portions can be freely selected as appropriate. A material for the grounding frame member 10 or the like is not particularly limited. It is preferable that each of the frame members 10, 30 is made of a metal pipe material. It is also preferable that the adjustment pole portion 51 and the pole reception portion 16 are made of metal in terms of strength. It is preferable that portions of the rear guide portion 55 and the front guide portion 56 that contact the rear rail portion 18 and the front rail portion 19, respectively, are made of metal. However, each of the portions may be covered with, for example, a flexible synthetic resin layer in order to absorb the strain on the whole wheelchair 1, achieve the prevention of deterioration due to friction between metal parts, and prevent squeaks.

The height adjustment mechanism 60 is not limited to that in the embodiments described above. For example, the height adjustment mechanism 60 may have a configuration in which the grounding frame member 10 includes a support portion for supporting the body frame member 30 from below. The body frame member 30 may be disposed inside or outside of the grounding frame member 10. The height adjustment mechanism 60 may have a configuration in which the grounding frame member 10 includes the adjustment pole portion 51 and the body frame member 30 includes the pole reception portion 16.

Figure 7A:
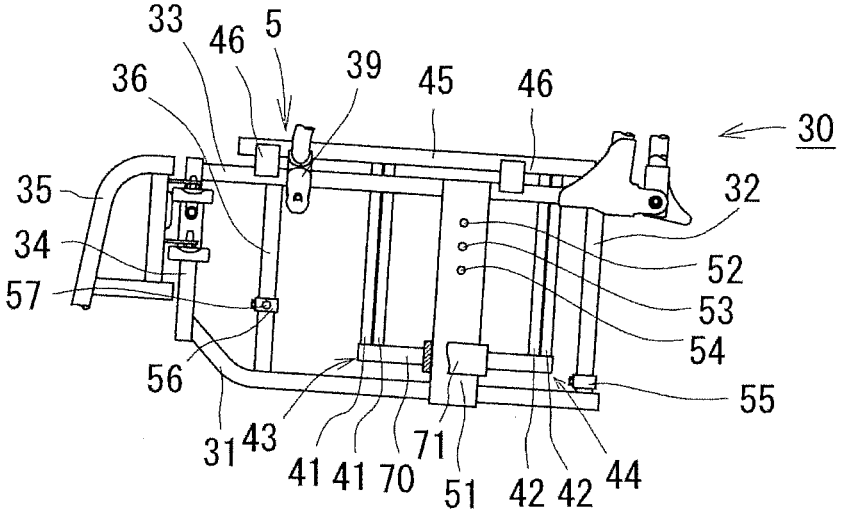
FIG. 7A and FIG. 7B are partially enlarged elevational views, illustrating a wheelchair according to another embodiment as a variant.
Figure 7B:
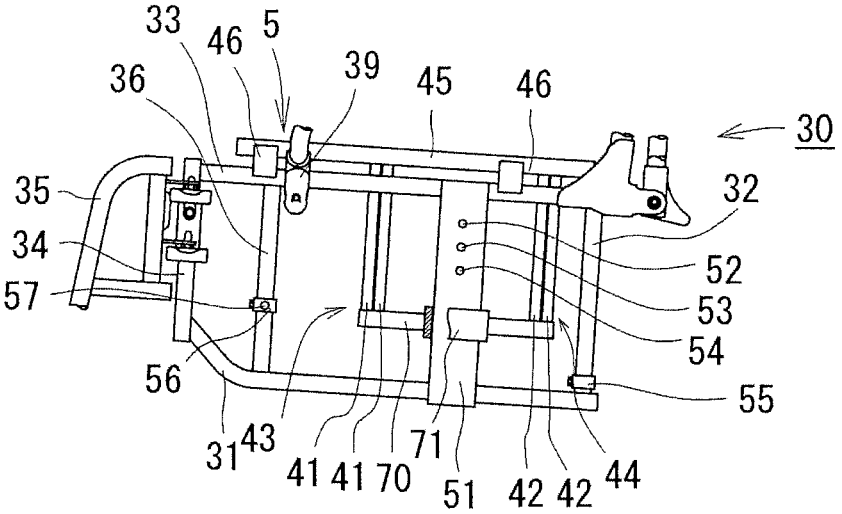

As illustrated in FIGS. 7A and 7B, lower end portions of the front X frame 43 and the rear X frame 44 in the body frame member 30 may be coupled with a coupling member 70. A sliding member 71 that has a cylindrical shape and is rotatably mounted on the coupling member 70 may be fitted onto the adjustment pole portion 51 of the body frame member 30 and engaged therewith. In such a configuration, a vertical position of the sliding member 71 is changed with respect to the adjustment pole portion 51 in accordance with a desired width of the wheelchair 1. With the desired width set up, a fixing means, which is not shown, such as a bolt and a nut (included in a slider holding portion) is inserted in any of a plurality of adjustment holes (not shown) arranged vertically in the adjustment pole portion 51. Then, the sliding member 71 is fixed in a predetermined position of the adjustment pole portion 51, and the pair of seat pipes 45 is connected to a seat pipe reception 46 without changing a length of the pairs of front rotational rods 41, 42. In this configuration, a seat width of the wheelchair 1 can be changed, and the sliding member 71 and the pole reception portion 16 are engaged with the adjustment pole portion 51. Thus, the structure is greatly simplified.

One embodiment is addressed to a wheelchair that enables a height adjustment of a seat portion. The wheelchair includes a grounding frame member, a body frame member, and a height adjustment mechanism. A front wheel and a rear wheel are mounted on the grounding frame member. The body frame member includes the seat portion and is assembled onto the grounding frame member. The grounding frame member and the body frame member are separately provided. The height adjustment mechanism changes a relative position between the grounding frame member and the body frame member and allows a change in height of the seat portion. The height adjustment mechanism includes an adjustment pole portion, a pole reception portion, and a fixing means. The adjustment pole portion is disposed vertically on one of the body frame member and the grounding frame member. The pole reception portion is disposed on the other of the body frame member and the grounding frame member so as to engage with the adjustment pole portion in a vertically movable manner. The fixing means fixes the adjustment pole portion and the pole reception portion such that the adjustment pole portion and the pole reception portion are unable to relatively move.

Such a configuration can save time and effort to individually adjust a height of the front wheel and the rear wheel. In other words, when a height position of the seat portion intended to be changed, only a height position of the body frame member with respect to the grounding frame member may be changed by the height adjustment mechanism. With the above-described configuration, the body frame member can move vertically with respect to the grounding frame member, and they can be fixed at appropriate height positions with the fixing means. Thus, a height of the seat portion can be adjusted with a simple configuration, and burdens of operations are greatly reduced. Furthermore, the grounding frame member and the body frame member are formed separately. Thus, a replacement method for replacing the grounding frame member with another grounding frame member can be adopted, for example.

A configuration is proposed that a parking brake for stopping rotation of the front wheel and/or the rear wheel by pressing against a peripheral surface of the front wheel and/or the rear wheel is mounted on the grounding frame member.

In a configuration in which the parking brake presses against the rear wheel, for example the configuration described above can save time and effort to finely adjust a position of the parking brake with respect to the rear wheel.

A configuration is proposed that one of the body frame member and the grounding frame member includes a rail portion disposed vertically. The other of the body frame member and the grounding frame member includes a guide portion engaged with the rail portion so as to move vertically along the rail portion.

With the configuration described above, occurrences of deformation or rattling between the body frame member and the grounding frame member can be prevented and also strength of the whole wheelchair can be improved.

In addition, a configuration is proposed that the wheelchair includes a pair of body frame members; the pair of body frame members each include the adjustment pole portion. The pair of body frame members is coupled with an X frame. The X frame is formed of a pair of rotational rods connected for rotation each other about the midpoint thereof. Lower end portions of the pair of rotational rods are rotatably mounted on a sliding member, which is engaged with the adjustment pole portion so as to move vertically, along the adjustment pole portion. Paired seat frame portions forming the seat portion are mounted on upper end portions of the pair of rotational rods. A fixing means that fixes the adjustment pole portion and the sliding member such that the adjustment pole portion and the sliding member are unable to relatively move is further provided. The sliding member is fixed in a predetermined position of the adjustment pole portion in accordance with a desired width of the wheelchair. The pair of seat frame portions is each connected to the pair of body frame members without changing the length of the pair of rotational rods.

Such a configuration can also change a seat width of the wheelchair. Here, the adjustment pole portion has a dual guide function that activates when the grounding frame member and the body frame member relatively move vertically and activates when the sliding member slides vertically to change a seat width. Therefore, the wheelchair is advantageous in that the whole wheelchair has many functions while its structure can be simplified.

Obviously, numerous modifications and variations of the present invention are possible in light of the above teachings. It is therefore to be understood that within the scope of the appended claims, the invention may be practiced otherwise than as specifically described herein.

What is claimed is:

1. A wheelchair frame structure comprising:

a grounding frame to which a front wheel and a rear wheel are to be provided;

a body frame mounted on the grounding frame and including a mount at which a seat is to be provided;

a height adjustment mechanism via which a relative position between the grounding frame and the body frame in a height direction of a wheelchair is changed, the height adjustment mechanism comprising:

an adjustment pole extending along the height direction and mounted on one of the body frame and the grounding frame;

a pole reception mounted on another of the body frame and the grounding frame and engaged with the adjustment pole slidably in the height direction; and a holding portion to hold not to relatively move the adjustment pole with respect to the pole reception;

a right body frame and a left body frame each comprising the adjustment pole;

an X frame coupled to the right body frame and the left body frame, the X frame comprising rotational rods connected for mutual rotation about midpoints thereof, a right seat frame and a left seat frame for the seat being mounted on upper ends of the rotational rods;

a slider which is slidably engaged with the adjustment pole in the height direction and on which lower ends of the rotational rods are rotatably mounted; and a slider holding portion to hold not to relatively move the adjustment pole with respect to the slider, wherein the slider is held at a predetermined position of the adjustment pole in accordance with a desired width of the wheelchair, and the right seat frame and the left seat frame are connected to the right body frame and the left body frame, respectively.

2. A wheelchair comprising:

the wheelchair frame structure according to claim 1;

the front wheel provided at the grounding frame;

the rear wheel provided at the grounding frame and provided opposite to the front wheel in a front-rear direction of the wheelchair; and the seat provided at the mount of the body frame.

3. The wheelchair according to claim 2, further comprising:

a parking brake to press against a peripheral surface of at least one wheel of the front wheel and the rear wheel about a rotation axis of the at least one wheel to stop rotation of the at least one wheel.

4. A method for adjusting the wheelchair according to claim 2, the method comprising:

releasing holding of the adjustment pole and the pole reception;

relatively sliding the adjustment pole and the pole reception in the height direction such that the mount of the body frame at which the seat is to be provided moves relative to the grounding frame in the height direction; and holding not to relatively move the adjustment pole with respect to the pole reception.

5. The wheelchair frame structure according to claim 1, wherein one of the body frame and the grounding frame comprises a rail extending along the height direction, and wherein the other of the body frame and the grounding frame comprises a rail guide engaged with the rail so as to move along the rail.

* * * * *